US010542600B2

(12) United States Patent
Lee et al.

(10) Patent No.: US 10,542,600 B2
(45) Date of Patent: Jan. 21, 2020

(54) LED DRIVING APPARATUS AND LIGHTING APPARATUS

(71) Applicant: SAMSUNG ELECTRONICS CO., LTD., Suwon-si, Gyeonggi-do (KR)

(72) Inventors: Bong Jin Lee, Hwaseong-si (KR); Kyu Cheol Kang, Suwon-si (KR); Kil Yoan Chung, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/936,543

(22) Filed: Mar. 27, 2018

(65) Prior Publication Data

US 2019/0075630 A1 Mar. 7, 2019

(30) Foreign Application Priority Data

Sep. 5, 2017 (KR) ..... 10-2017-0113170

(51) Int. Cl.
*H05B 33/08* (2006.01)
*H05B 37/02* (2006.01)

(52) U.S. Cl.
CPC ..... *H05B 33/0845* (2013.01); *H05B 33/0806* (2013.01); *H05B 33/0815* (2013.01); *H05B 37/02* (2013.01)

(58) Field of Classification Search
CPC ..... H05B 33/08; H05B 33/0815; H05B 33/0842; H05B 33/0845; H05B 33/0848; H05B 33/0851; H05B 33/0854; H05B 37/02
See application file for complete search history.

(56) References Cited

U.S. PATENT DOCUMENTS

| | | | |
|---|---|---|---|
| 6,372,608 | B1 | 4/2002 | Shimoda et al. |
| 6,645,830 | B2 | 11/2003 | Shimoda et al. |
| RE38,466 | E | 3/2004 | Inoue et al. |
| 6,818,465 | B2 | 11/2004 | Biwa et al. |
| 6,818,530 | B2 | 11/2004 | Shimoda et al. |
| 6,858,081 | B2 | 2/2005 | Biwa et al. |
| 6,967,353 | B2 | 11/2005 | Suzuki et al. |
| 7,002,182 | B2 | 2/2006 | Okuyama et al. |
| 7,084,420 | B2 | 8/2006 | Kim et al. |
| 7,087,932 | B2 | 8/2006 | Okuyama et al. |
| 7,154,124 | B2 | 12/2006 | Han et al. |
| 7,208,725 | B2 | 4/2007 | Sherrer et al. |
| 7,288,758 | B2 | 10/2007 | Sherrer et al. |

(Continued)

FOREIGN PATENT DOCUMENTS

| | | |
|---|---|---|
| JP | 2011-60696 A | 3/2011 |
| JP | 2012-190959 | 10/2012 |

(Continued)

*Primary Examiner* — Thai Pham
(74) *Attorney, Agent, or Firm* — Lee & Morse, P.C.

(57) ABSTRACT

A light emitting diode driving apparatus includes a rectifier, a converter, a feedback circuit, and a controller. The rectifier converts alternating current power to direct current (DC) power. The converter supplies driving power to a plurality of LEDs based on the DC power. The feedback circuit generates a feedback signal based on a current flowing in the plurality of LEDs and adjusts a magnitude of the feedback signal. The controller changes a maximum value of a current output by the converter based on the adjusted magnitude of the feedback signal.

13 Claims, 16 Drawing Sheets

(56) References Cited

U.S. PATENT DOCUMENTS

| | | | | |
|---|---|---|---|---|
| 7,319,044 | B2 | 1/2008 | Han et al. | |
| 7,501,656 | B2 | 3/2009 | Han et al. | |
| 7,633,245 | B2 | 12/2009 | Pruett | |
| 7,709,857 | B2 | 5/2010 | Kim et al. | |
| 7,759,140 | B2 | 7/2010 | Lee et al. | |
| 7,781,727 | B2 | 8/2010 | Sherrer et al. | |
| 7,790,482 | B2 | 9/2010 | Han et al. | |
| 7,940,350 | B2 | 5/2011 | Jeong | |
| 7,959,312 | B2 | 6/2011 | Yoo et al. | |
| 7,964,881 | B2 | 6/2011 | Choi et al. | |
| 7,985,976 | B2 | 7/2011 | Choi et al. | |
| 7,994,525 | B2 | 8/2011 | Lee et al. | |
| 8,008,683 | B2 | 8/2011 | Choi et al. | |
| 8,013,352 | B2 | 9/2011 | Lee et al. | |
| 8,049,161 | B2 | 11/2011 | Sherrer et al. | |
| 8,054,283 | B2 | 11/2011 | Lee et al. | |
| 8,129,711 | B2 | 3/2012 | Kang et al. | |
| 8,179,938 | B2 | 5/2012 | Kim | |
| 8,263,987 | B2 | 9/2012 | Choi et al. | |
| 8,274,237 | B2 | 9/2012 | Nagase et al. | |
| 8,324,646 | B2 | 12/2012 | Lee et al. | |
| 8,399,944 | B2 | 3/2013 | Kwak et al. | |
| 8,432,511 | B2 | 4/2013 | Jeong | |
| 8,459,832 | B2 | 6/2013 | Kim | |
| 8,502,242 | B2 | 8/2013 | Kim | |
| 8,536,604 | B2 | 9/2013 | Kwak et al. | |
| 8,581,518 | B2 | 11/2013 | Kuang et al. | |
| 8,735,931 | B2 | 5/2014 | Han et al. | |
| 8,766,295 | B2 | 7/2014 | Kim | |
| 8,773,041 | B2 | 7/2014 | Chen | |
| 8,884,541 | B2 | 11/2014 | Wu | |
| 9,131,563 | B2 | 9/2015 | Kunimatsu | |
| 9,167,643 | B2 | 10/2015 | Xu et al. | |
| 9,167,653 | B2 | 10/2015 | Takahashi et al. | |
| 10,039,171 | B1 * | 7/2018 | Li | H05B 33/0887 |
| 2007/0024213 | A1 * | 2/2007 | Shteynberg | H05B 33/0815 315/291 |
| 2010/0156323 | A1 | 6/2010 | Jan et al. | |
| 2011/0019446 | A1 * | 1/2011 | Wu | H02M 3/33523 363/79 |
| 2011/0025217 | A1 * | 2/2011 | Zhan | H02M 3/335 315/219 |
| 2011/0175543 | A1 * | 7/2011 | Sun | H05B 33/0818 315/291 |
| 2013/0278154 | A1 | 10/2013 | Kim | |
| 2013/0313985 | A1 * | 11/2013 | Choi | H05B 33/0815 315/192 |
| 2014/0252974 | A1 | 9/2014 | Kim et al. | |
| 2016/0140912 | A1 | 5/2016 | Im et al. | |
| 2017/0171926 | A1 * | 6/2017 | Kim | H05B 33/0818 |
| 2018/0324920 | A1 * | 11/2018 | Luccato | H02M 3/33553 |

FOREIGN PATENT DOCUMENTS

| | | | |
|---|---|---|---|
| KR | 10-0732851 | B1 | 6/2007 |
| KR | 10-1028587 | B1 | 4/2011 |
| KR | 10-1034899 | B1 | 5/2011 |
| KR | 10-1049972 | B1 | 7/2011 |
| KR | 10-1189434 | B1 | 10/2012 |
| KR | 10-1278540 | B1 | 6/2013 |
| KR | 10-1296364 | B1 | 8/2013 |
| KR | 10-2013-0130526 | A | 12/2013 |
| KR | 10-2014-0017212 | A | 2/2014 |
| KR | 10-2016-0122544 | A | 10/2016 |

* cited by examiner

LED DRIVING APPARATUS AND LIGHTING APPARATUS

CROSS-REFERENCE TO RELATED APPLICATION

Korean Patent Application No. 10-2017-0113170, filed on Sep. 5, 2017, and entitled, "Led Driving Apparatus and Lighting Apparatus," is incorporated by reference herein in its entirety.

BACKGROUND

1. Field

One or more embodiments described herein relate to an LED driving apparatus and a lighting apparatus.

2. Description of the Related Art

Light emitting diodes and other types of semiconductor light emitting devices have low power consumption, a high degree of brightness, and a long lifespan, and thus are suitable for many applications. Some examples of these applications include backlights for displays and light sources for various types of lighting devices.

SUMMARY

In accordance with one or more embodiments, a light emitting diode driving apparatus includes a rectifier to convert alternating current (AC) power to direct current (DC) power; a converter to supply driving power to a plurality of LEDs based on the DC power; a feedback circuit to generate a feedback signal based on a current flowing in the plurality of LEDs and provide a unit capable of adjusting a magnitude of the feedback signal; and a controller to change a maximum value of a current output by the converter based on the adjusted magnitude of the feedback signal.

In accordance with one or more other embodiments, an LED driving apparatus includes an LED driver to receive AC power and supply driving power to a light source including a plurality of LEDs; an input harness including a plurality of input terminals to transmit the AC power to the LED driver; and an output harness including a plurality of output terminals to transmit the driving power to the light source and a current control terminal to adjust a maximum current output by the LED driver.

In accordance with one or more other embodiments, a lighting apparatus includes a light source including a plurality of LEDs; and an LED driving apparatus to receive AC power, drive the light source, and detect a current flowing through the plurality of LEDs to change a maximum value of an output current supplied to the light source.

BRIEF DESCRIPTION OF DRAWINGS

Features will become apparent to those of skill in the art by describing in detail exemplary embodiments with reference to the attached drawings in which.

DETAILED DESCRIPTION

Figure 1:
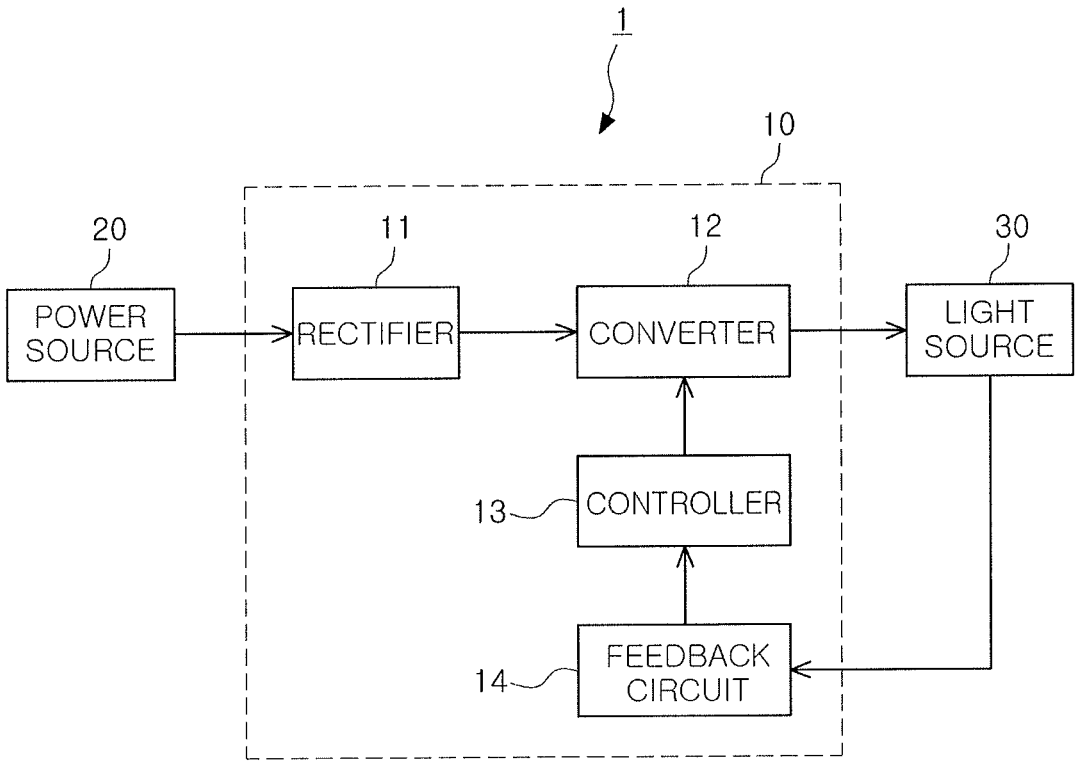
FIG. 1 illustrate an embodiment of a lighting apparatus.

FIG. 1 illustrates an embodiment of a lighting apparatus 1 which may include a light emitting diode (LED) driving apparatus 10, a power source 20, and a light source 30. The light source 30 may include a plurality of LEDs, and the LED driving apparatus 10 may generate driving power for driving the plurality of LEDs in the light source 30 using alternating current (AC) power supplied by the power source 20.

The LED driving apparatus 10 may include a rectifier 11, a converter 12, a controller 13, and a feedback circuit 14. The rectifier 11 may rectify AC power supplied by the power source 20 to convert the rectified power into direct current (DC) power. The converter 12 may include a flyback converter, a PFC converter, a buck converter, a boost converter, or an LLC converter. The rectifier 11 may generate driving power to drive the plurality of LEDs.

The controller 13 may control the converter 12 to output driving power suitable for the plurality of LEDs. In an example embodiment, the controller 13 may control an on/off operation of at least one switching element in the converter 12 based on a clock signal. The clock signal may have a predetermined frequency and a duty ratio for adjusting driving power output by the converter 12. The controller 13 may receive an external control command through wired communications or wireless communications, and may adjust a magnification or amplification of the driving power output by the converter 12 based on the control command.

The feedback circuit 14 may transmit a feedback signal to the controller 13. In an example embodiment, the feedback circuit 14 may generate the feedback signal by detecting current flowing through the plurality of LEDs in the light source 30 and comparing the detected current with a reference voltage.

In an example embodiment, at least one circuit element in the feedback circuit 14 may a value that is adjustable. The value may be adjusted based on a signal generated by a program or a user. For example, a maximum value of current to be output by the LED driving apparatus 10 may be adjusted. For example, when a forward voltage of the plurality of LEDs in the light source 30 is lowered, or when an output of light from the plurality of LEDs is lower than an expected level, electric current output by the LED driving apparatus 10 may be intentionally increased in order to obtain a desired light-output from the light source 30.

Figure 2:
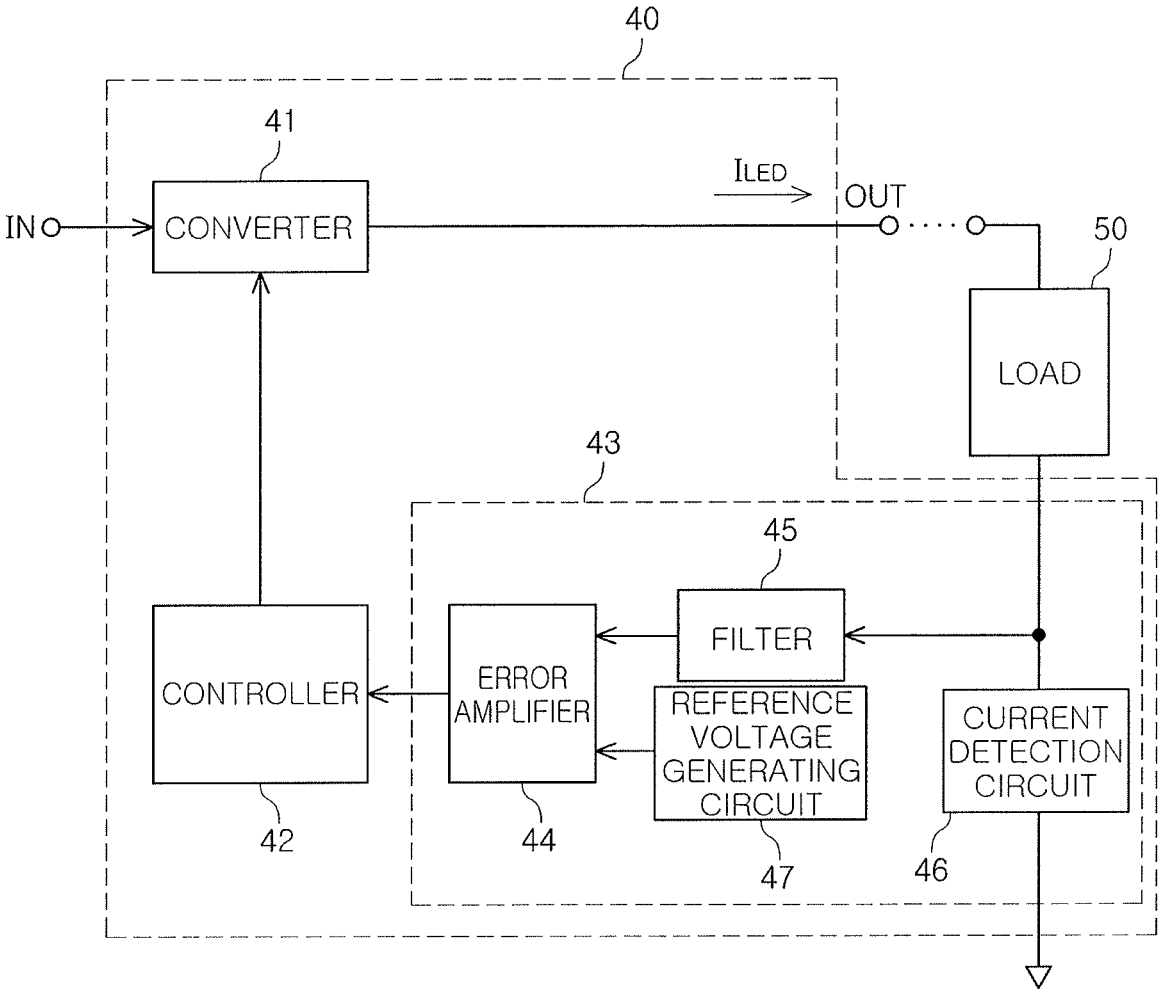
FIG. 2 illustrate an embodiment of an LED driving apparatus.

FIG. 2 illustrates an embodiment of an LED driving apparatus 40 which may include a converter 41, a controller 42, and a feedback circuit 43. As described with reference to FIG. 1, the converter 41 may include a flyback converter, a PFC converter, a buck converter, a boost converter, or an LLC converter. In an example embodiment, the converter 41 may include two or more converters connected to each other in series.

The controller 42 may control the converter 41. The controller 42 may receive the feedback signal from an error amplifier 44, and a frequency and a duty ratio of the control signal input to the converter 41 by the controller 42 may be changed based on the feedback signal. Thus, the magnitude of the driving power output from the converter 41 may be changed depending on the feedback signal. For example, a maximum value of an output current $I_{LED}$ supplied to a load 50 including a plurality of LEDs by the converter 41 may be increased to a value higher than a rated current. Thus, a reduction in a forward voltage of the plurality of LEDs and/or degradation of light output may be effectively prevented.

The feedback circuit 43 may include the error amplifier 44, a filter 45, a current detection circuit 46, and a reference voltage generating circuit 47. The feedback circuit 43 may provide the feedback signal to the controller 42. The current detection circuit 46 may detect the output current $I_{LED}$ flowing through the plurality of LEDs in order to generate a sensing voltage. The current detection circuit 46 may include, for example, a sensing resistor for detecting the output current $I_{LED}$. The sensing voltage may be input to an input terminal of the error amplifier 44 via the filter 45. In an example embodiment, the filter 45 may be a low pass filter.

The reference voltage generating circuit 47 may generate a reference voltage for input to the input terminal of the error amplifier 44. In an example embodiment, the reference voltage may be input to a non-inverting terminal of the error amplifier 44, and a sensing voltage may be input to an inverting terminal of the error amplifier 44. The magnitude of the feedback signal output by the error amplifier 44 may be determined based on a difference between the reference voltage and the sensing voltage, a DC component of an output voltage of the error amplifier 44, and/or a gain of the error amplifier 44.

In an example embodiment, the feedback circuit 43 may include a current control unit for changing a maximum current output by the LED driving apparatus 40. The maximum current may be changed, for example, by adjusting the magnitude of the feedback signal. The magnitude of the feedback signal may be changed, for example, based on a signal generated by a user or by control software. In an example embodiment, the current control unit may be provided in at least one of the error amplifier 44, the filter 45, the current detection circuit 46, and the reference voltage generating circuit 47. In an example embodiment, for example, when a user manipulates the current control unit to change the magnitude of the feedback signal, a maximum value of the output current $I_{LED}$ of the LED driving apparatus 40 may increase or decrease.

When a forward voltage of an LED is decreased or desired light output may not be obtained in a process in which the LED driving apparatus 40 is installed or is operated, a user may manipulate the current control unit to forcibly increase a maximum value of the output current $I_{LED}$ of the LED driving apparatus 40, to thereby obtain a desired amount of light.

Figure 3:
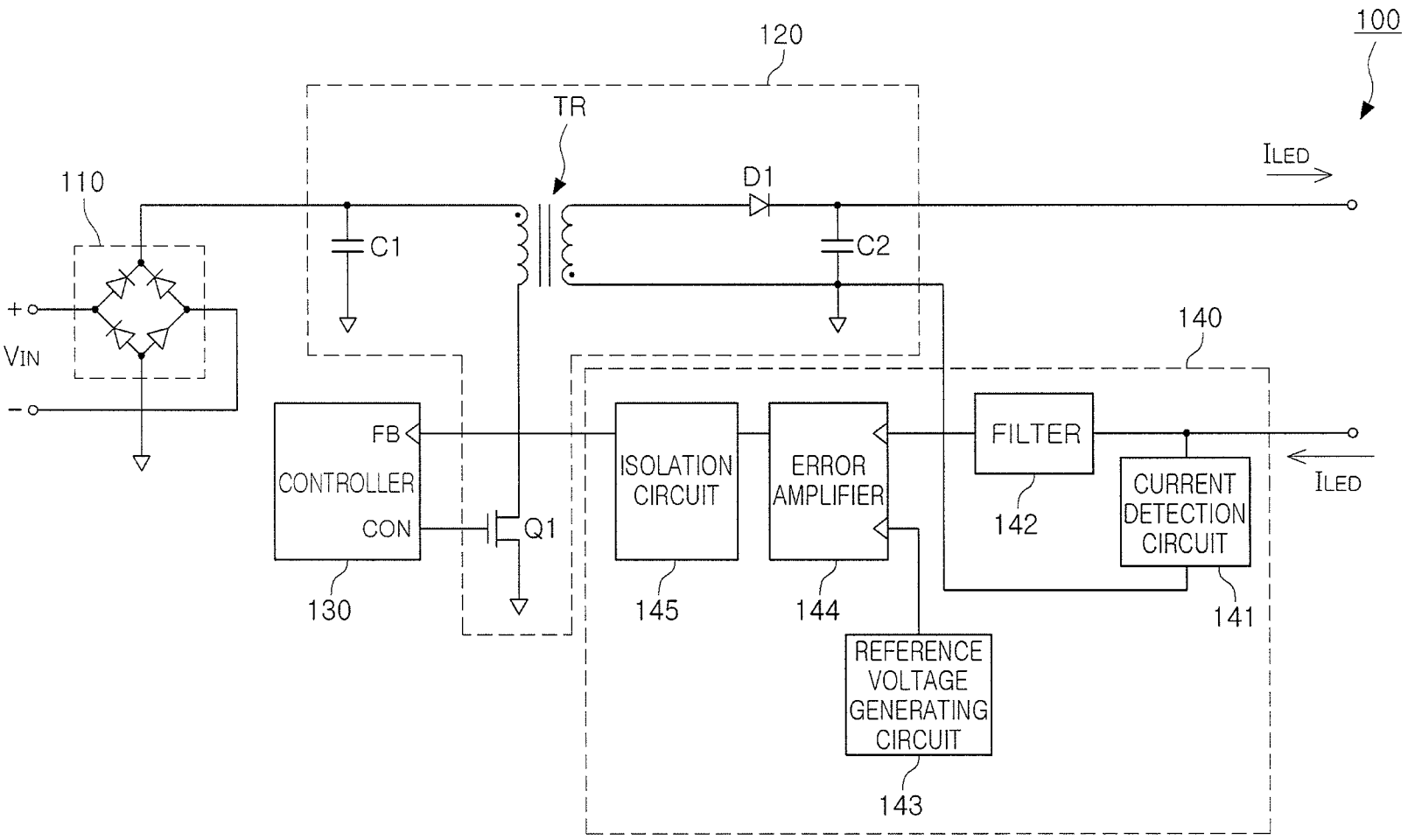
FIGS. 3 to 5 illustrate circuit embodiments of LED driving apparatuses.
Figure 4:
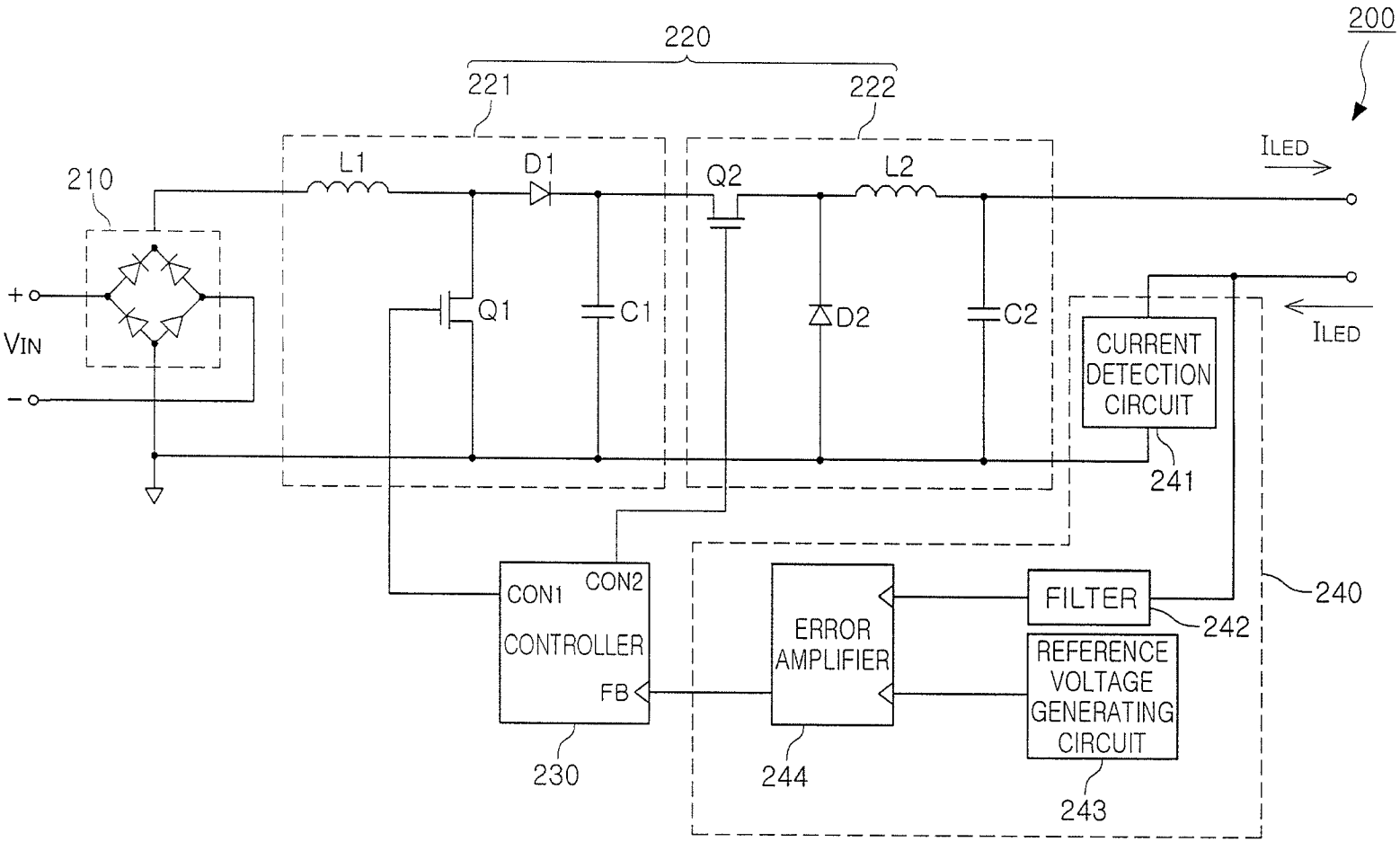
Figure 5:
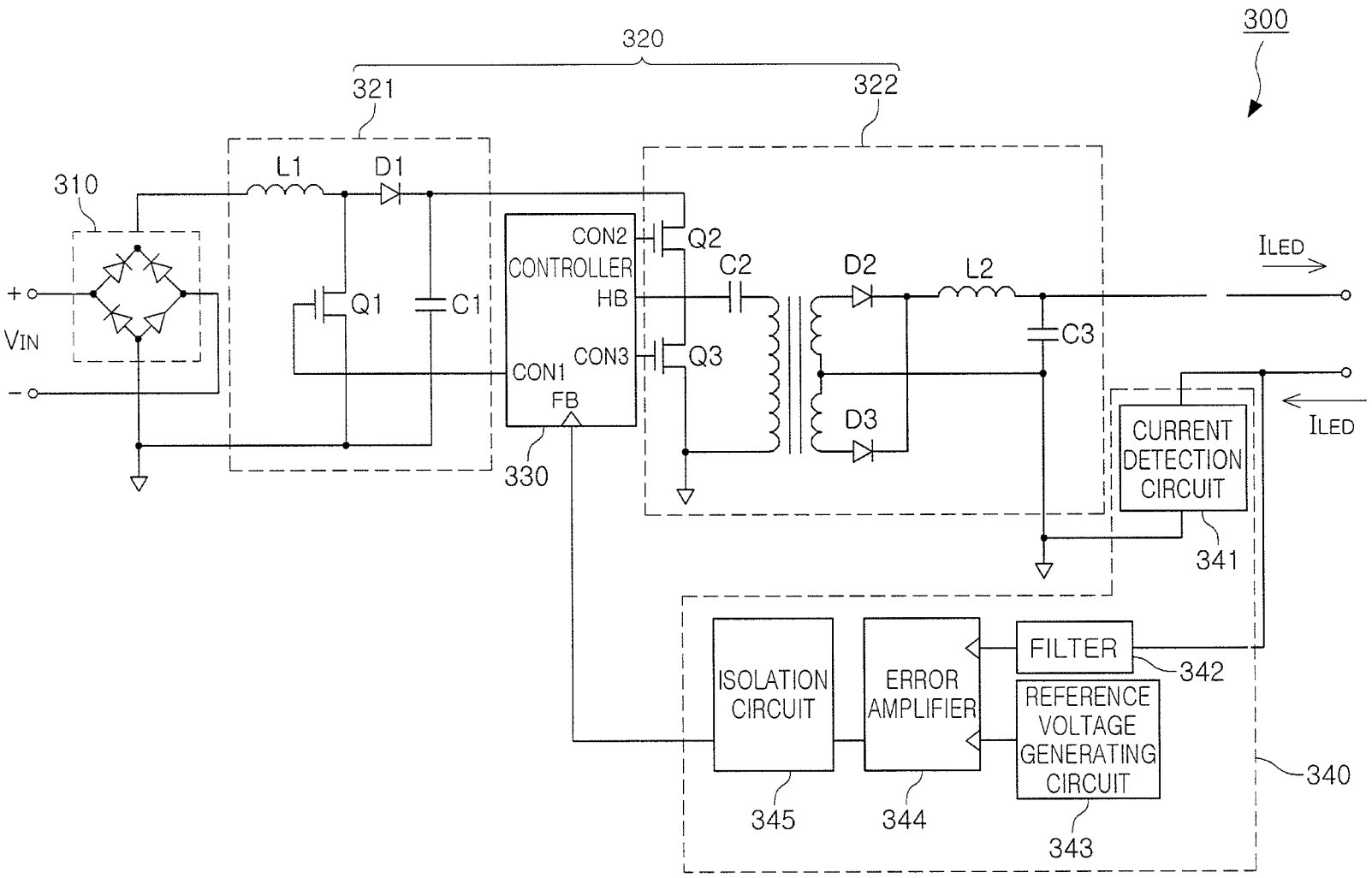

FIGS. 3 to 5 illustrate circuit embodiments of LED driving apparatuses.

FIG. 3 illustrates an embodiment of an LED driving apparatus 100 which may include a rectifier 110, a converter 120, a controller 130, and a feedback circuit 140. The rectifier 110 may include a diode bridge circuit to rectify an input voltage $V_{IN}$. In an example embodiment, the input voltage $V_{IN}$ may be a voltage supplied from a commercial AC power source.

In the example embodiment illustrated in FIG. 3, the converter 120 may include a flyback converter circuit. Referring to FIG. 3, the converter 120 may include a transformer TR, a main switch Q1, a diode D1, and capacitors C1 and C2. For example, a first capacitor C connected to a primary winding of the transformer TR may be a bypass capacitor that may remove, for example, a high frequency noise component from an input terminal signal.

The main switch Q1 may be implemented by a semiconductor device, e.g., a field-effect transistor. The main switch Q1 may be connected to the primary winding of the transformer TR in series, and may operate based on a control signal output by the controller 130.

The diode D1 and the capacitor (e.g., a second capacitor C2) may be connected to a secondary winding of the transformer TR. For example, when the main switch Q1 is turned on, energy may be stored in the transformer TR based on a voltage output by the rectifier 110, and the diode D1 may be biased in a reverse direction. Thus, the voltage output by the rectifier 110 may not be transmitted to a secondary side of the transformer 123. At this time, the output current $I_{LED}$ may be generated by the energy stored in the second capacitor C2. When, for example the main switch Q1 is turned off, the diode D1 may be biased in a forward direction and the output current $I_{LED}$ may be generated by the energy stored in the transformer TR.

The controller 130 may receive the feedback signal, output from the feedback circuit 140, via a feedback signal input terminal FB. The feedback circuit 140 may include a current detection circuit 141, a filter 142, a reference voltage generating circuit 143, and an error amplifier 144. The current detection circuit 141 may include a sensing resistor for detecting the output current $I_{LED}$ of the converter 120 in order to generate a sensing voltage. In an example embodiment, the filter 142 may be a low pass filter for removing a high frequency noise component in the sensing voltage. The reference voltage generating circuit 143 may generate a predetermined reference voltage. The error amplifier 144 may calculate and amplify a difference between the sensing voltage and the reference voltage to generate a feedback signal.

In an example embodiment, the feedback signal may be determined, for example, based on the sensing voltage, the reference voltage, and/or characteristics of the error amplifier 144. The controller 130 may generate a control signal for controlling the main switch Q1 based on the feedback signal. Thus, the feedback signal may be adjusted by the current control unit (e.g., based on a user signal) in order to cause the controller 130 to change the characteristics of the control signal output to the main switch Q1. As a result, a maximum value of the output current $I_{LED}$ of the converter 120 may be changed. In one embodiment, the rated current of the converter 120 may be increased based on the change in magnitude of the feedback signal made by the user.

In an example embodiment, a unit for changing a value of an element in the current detection circuit 141, the filter 142, and/or the reference voltage generating circuit 143, or a unit for changing the gain of the error amplifier 144, an operating voltage, and/or a DC offset component, may be the current control unit subject to adjustment by a user. For example, when a user adjusts the current control unit, the magnitude of the feedback signal and characteristics of the control signal input to the main switch Q1 by the controller 130 may be changed, and a rated current of the converter 120 may be increased. Thus, for example, when desired output light is not obtained from the plurality of LEDs connected to an output terminal of the converter 120, the user may forcibly increase the rated current of the converter 120 using the current control unit, thereby obtaining the desired amount or type of output light.

Referring to FIG. 4, an LED driving apparatus 200 may include a rectifier 210, a converter 220, a controller 230, and a feedback circuit 240. The rectifier 210 and the feedback circuit 240 may be similar to the rectifier 110 and the feedback circuit 140 of FIG. 3. In an example, the feedback circuit 240 may include a current detection circuit 241, a filter 242, a reference voltage generating circuit 243, and an error amplifier 244.

In the example embodiment illustrated in FIG. 4, the converter 220 may include a first converter 221 and a second converter 222. In an example embodiment, the first converter 221 may be a PFC converter and the second converter 222 may be a buck converter. The first converter 221 may include a first inductor L1, a first diode D1, a first capacitor C1, and a first main switch Q1. For example, when the first main switch Q1 is turned off, the first capacitor C1 may be charged by an output of the rectifier 210. When the first main switch Q1 is turned on, a voltage generated by the first capacitor C1 may be transmitted to the second converter 222.

The second converter 222 may include a second inductor L2, a second diode D2, a second capacitor C2, and a second main switch Q2. For example, when the second main switch Q2 is turned on, a voltage generated by the first capacitor C1 of the first converter 221 may be applied to the second inductor L2 in order to generate an output current $I_{LED}$. When the second main switch Q2 is turned off, an output current $I_{LED}$ may be generated by a loop circuit formed by the second inductor L2, the second capacitor C2, and the second diode D2.

The controller 230 may control the first main switch Q1 and the second main switch Q2 to determine the output current $I_{LED}$. The feedback circuit 240 may input a feedback signal to a feedback signal input terminal FB of the controller 230. The controller 230 may change a maximum value of the output current $I_{LED}$ based on the feedback signal. For example, the controller 230 may change a rated current of the converter 220 based on the feedback signal.

The feedback circuit 240 may include at least one current control unit for adjusting the feedback signal. A rated current of the converter 220 may be changed by adjusting the feedback signal (e.g., by a user or control software) using the current control unit. As an example, the current control unit may include a unit for adjusting a reference voltage generated by a reference voltage generating circuit 243 and/or a unit for adjusting a gain of the error amplifier 244. For example, when a user adjusts the reference voltage or the gain of the error amplifier 244, the rated current of the converter 220 may be increased based on the adjustment. Desired output light may be simply obtained without having to replace the LED driving apparatus 200 or the LEDs used as light sources.

Referring to FIG. 5, an LED driving apparatus 300 may include a rectifier 310, a converter 320, a controller 330, and a feedback circuit 340. The rectifier 310 and the feedback circuit 340 may be similar to the rectifiers 110 and 210 and the feedback circuits 140 and 240 according to the foregoing example embodiments. In an example, the feedback circuit 340 may include a current detection circuit 341, a filter 342, a reference voltage generating circuit 343, and an error amplifier 344.

In the example embodiment illustrated in FIG. 5, the converter 320 may include a first converter 321 and a second converter 322. In one embodiment, the first converter 321 may be a PFC converter and the second converter 322 may be a half bridge LLC converter. The first and second converters 321 and 322 may be different types of circuits in other embodiments. Operation of the first converter 321 may be similar to that of the first converter 221 illustrated in FIG. 4.

The second converter 322 may include second and third main switches Q2 and Q3, second and third capacitors C2 and C3, second and third diodes D2 and D3, a second inductor L2, and a transformer TR. The second and third main switches Q2 and Q3 may be alternately turned on. For example, when the second main switch Q2 is turned on, an output current $I_{LED}$ may be output through the second diode D2. When the third main switch Q3 is turned on, the output current $I_{LED}$ may be output through the third diode D3.

The controller 330 may change a rated current of the converter 320 based on a feedback signal FB. The feedback signal FB may be determined by a sensing voltage generated by the current detection circuit 341, a reference voltage generated by the reference voltage generating circuit 343, a gain of the error amplifier 344, and/or a DC component of the error amplifier 344. In one embodiment of the current control unit, the feedback circuit 340 may allowing at least one of the parameters above to be adjusted by a user in order to change the feedback signal FB. Thus, when desired light is not output from a plurality of LEDs used as light sources, the user may forcibly increase a rated current of the converter 320 by adjusting the current control unit. As a result, desired light output may be obtained without having to replace the LED driving apparatus 300 or the LEDs.

FIGS. 6 to 11 illustrate more circuit embodiments of an LED driving apparatus.

Figure 6:
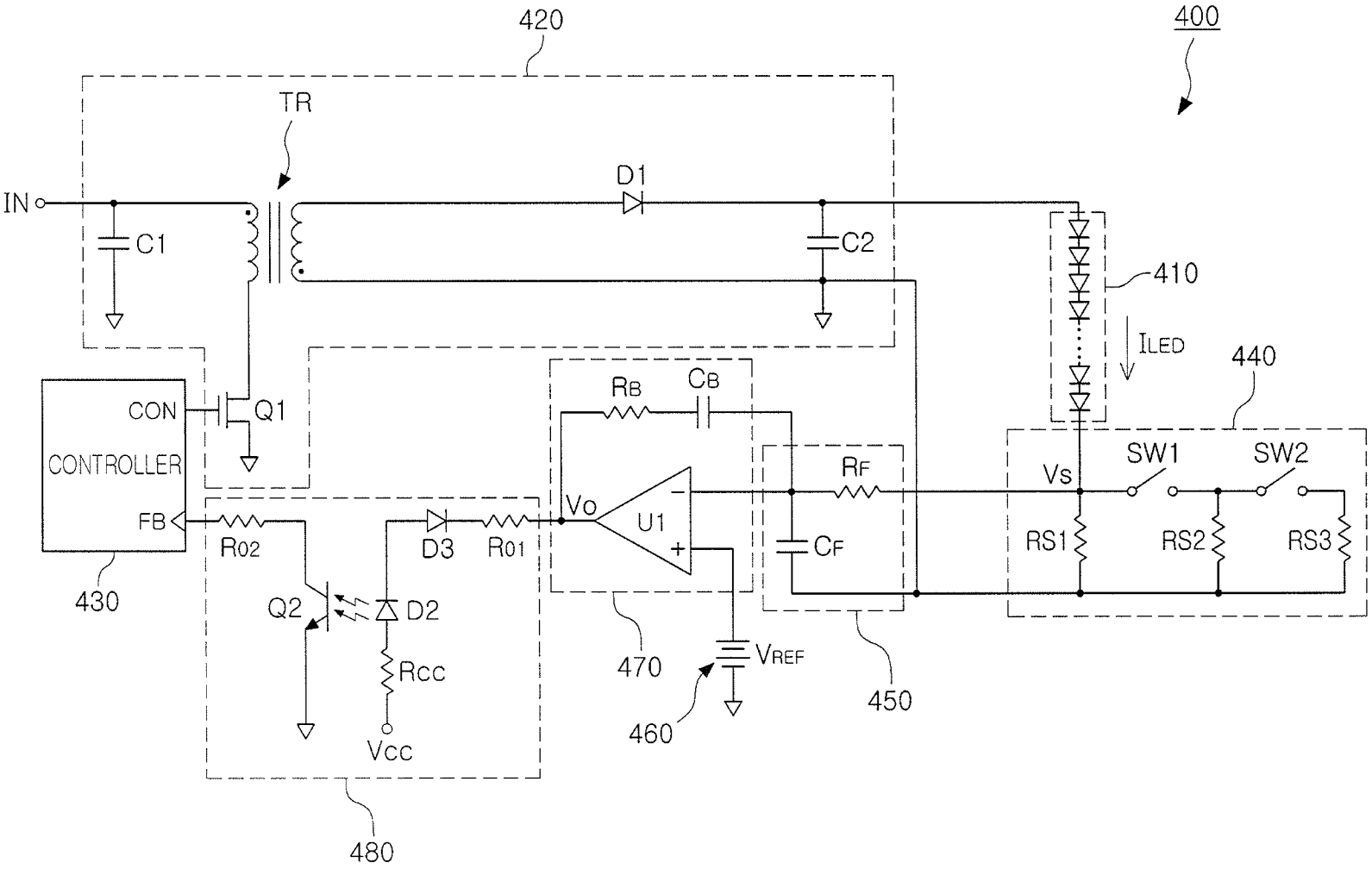
FIGS. 6 to 11 illustrate more circuit embodiments of LED driving apparatuses.

Referring to FIG. 6, an LED driving apparatus 400 may supply driving power to a plurality of LEDs 410. The LED driving apparatus 400 may include a converter 420, a controller 430, a current detection circuit 440, a filter 450, a reference voltage generating circuit 460, an error amplifier 470, and a photocoupler 480.

The converter 420 may be a circuit driving the LEDs 410 implemented to have various topologies. Although the embodiments of FIGS. 6 to 11 illustrate that the converter 420 is implemented as a flyback converter by way of example, the converter 420 may also include other circuits, e.g., as a PFC converter, a buck converter, a boost converter, a buck-boost converter, a forward converter, an LLC converter, or an LCC converter.

The current detection circuit 440, the filter 450, the reference voltage generating circuit 460, and the error amplifier 470 may be included in a feedback circuit which provides a feedback signal to the controller 430. The feedback circuit may generate a sensing voltage Vs by detecting a current flowing through the LEDs 410 connected to a secondary winding of the transformer TR and may compare the generated sensing voltage Vs to a reference voltage $V_{REF}$ to generate the feedback signal. Thus, the controller 430 (which controls a main switch Q1 connected to a primary winding of the transformer TR) may receive the feedback signal through the photocoupler 480. At least one of the current detection circuit 440, the filter 450, the reference voltage generating circuit 460, and the error amplifier 470 may include a current control unit for adjusting the feedback signal.

In an example embodiment illustrated in FIG. 6, the current detection circuit 440 may include a plurality of sensing resistors RS1 to RS3 and a plurality of switching elements SW1 and SW2. On/off switching of the switching elements SW1 and SW2 may be determined, for example, based on a user signal. For example, a device for turning on/off the respective switching elements SW1 and SW2 may be provided to (or be made accessible to) the user as a current control unit.

In an example embodiment illustrated in FIG. 6, resistance of a filter resistor $R_F$ in the filter 450, resistance of a feedback resistor $R_B$ connected between an output terminal and an inverting terminal of an operational amplifier U1, and a reference voltage $V_{REF}$ (except for a resistance value of the current detection circuit 440) may be constant. An output voltage Vo of the error amplifier 470 may be reduced as the resistance value of the current detection circuit 440 decreases. For example, when the switching elements SW1 and SW2 are turned so that the sensing resistors RS1 to RS3 are connected in parallel, the sensing voltage Vs may decrease to increase the output voltage Vo of the error amplifier 470.

In one embodiment, when the output voltage Vo of the error amplifier 470 increases, a current of a light emitting diode D2 operated by a power supply voltage Vcc may decrease thereby. Thus, a base voltage of a light-receiving element Q2 may decrease. As the base voltage of the light-receiving element Q2 decreases, a voltage between a collector and an emitter of the light-receiving element Q2 may increase. The controller 430 may sense the increased voltage and, thus, may control the converter 420 to increase a rated current. In an example embodiment, the controller 430 may increase the rated current of the converter 420 by adjusting a switching frequency of the main switch Q1.

When light output of the LEDs 410 does not reach a desired value, a user may, for example, generate a signal to turn on the switching elements SW1 and SW2 of the current detection circuit 440 to forcibly increase the rated current output from the converter 420. Because a user may adjust the rated current as desired to forcibly control (e.g., increase) the light output of the LEDs 410, desired light may be output under various circumstances with simple manipulation, e.g., when light output is to be lowered during installation and operation of the LED driving apparatus 400. On the other hand, as the rated current output by the converter 420 increases, input power input to the LED driving apparatus 400 may also increase.

Figure 7:
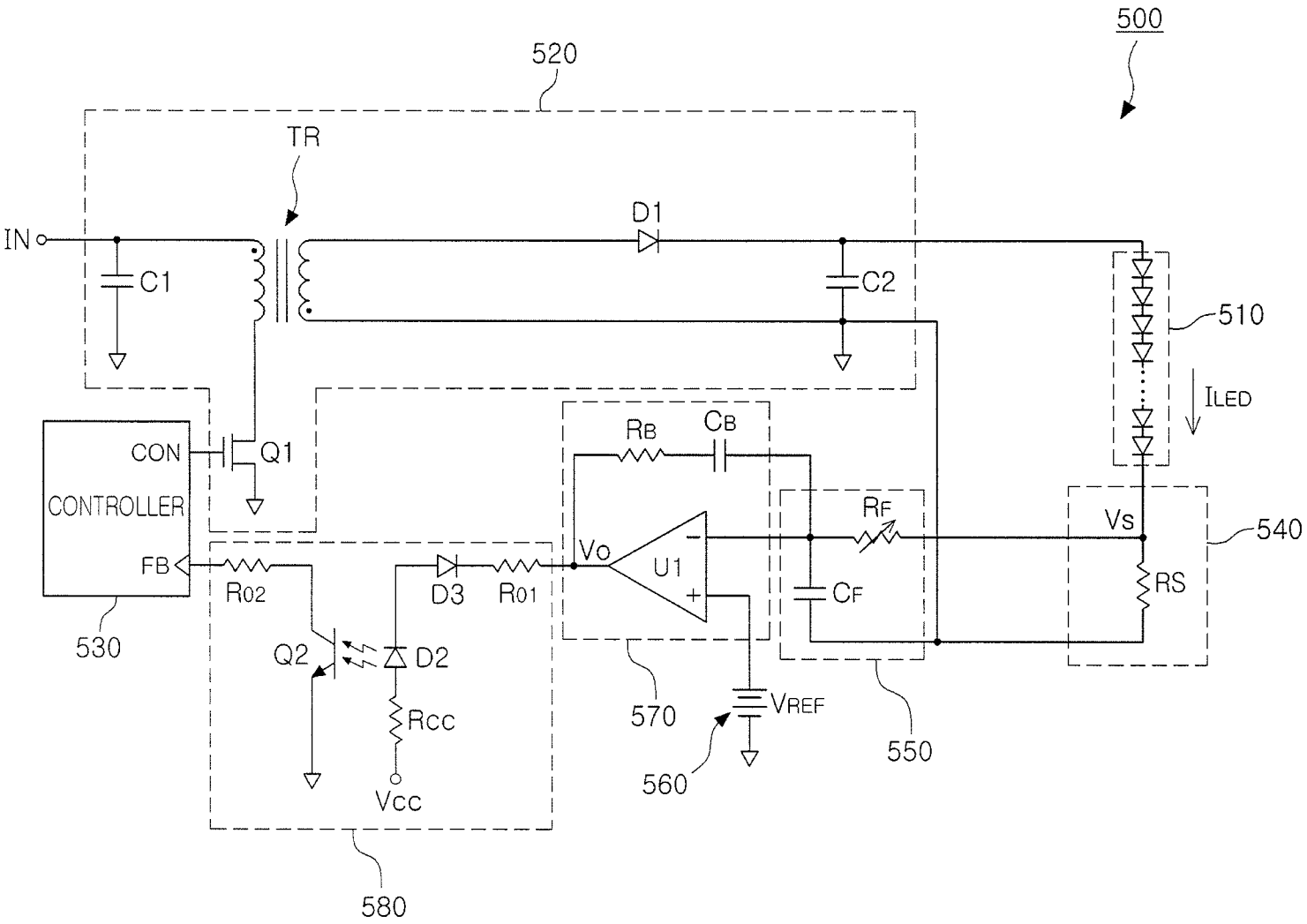

Then, referring to FIG. 7, main components of an LED driving apparatus 500 may be similar to those in the example embodiment illustrated in FIG. 6, except for a feedback circuit. Similarly to the description with reference to FIG. 6, the converter 520 may be implemented by a variety of circuits, e.g., a PFC converter, a buck converter, a boost converter, a buck-boost converter, a forward converter, an LLC converter, an LCC converter, or a flyback converter.

In an example embodiment illustrated in FIG. 7, a feedback circuit may include a current detection circuit 540, a filter 550, a reference voltage generating circuit 560, an error amplifier 570, and a photocoupler 580. In a manner different from the example embodiment illustrated in FIG. 6, the current detection circuit 540 may include a sensing resistor RS having a fixed value, and a filter resistor $R_F$ in the filter 550 may be implemented as a variable resistor. A value of the filter resistor $R_F$ may affect the voltage gain of the error amplifier 570, and a device for increasing or decreasing a value of the filter resistor $R_F$ may be provided to a user, as a current control unit.

As an impedance value of the filter 550 increases, an output voltage Vo of the error amplifier 570 may increase. For example, when a user determines that light output of LEDs 510 (which receive a rated current from the converter 520 to emit light) is lower than a required light output, the user may adjust the resistance of the filter resistor $R_F$ in order to increase impedance of the filter 550. When the resistance of the filter resistor $R_F$ increases, an output voltage Vo of the error amplifier 570 increases. The controller 530 may then increase the rated current of the converter 520 (based on a change in a feedback signal) based on the increase in output voltage Vo. Thus, a maximum value of a current that may be output by the converter 520 may be increased by adjusting the resistance of the filter resistor $R_F$. In an example embodiment, adjusting the resistance of the filter resistor $R_F$ may increase the rated current of the converter 520 by about 10%.

When the amount of light output by a light emitting diode D2 of the photocoupler 580 decreases as the output voltage Vo increases, the controller 530 may sense a corresponding change in impedance of the light-receiving element Q2. As the controller 530 controls an operation of a main switch Q1 to increase the rated current of the converter 520, a user may obtain a desired light output.

Figure 8:
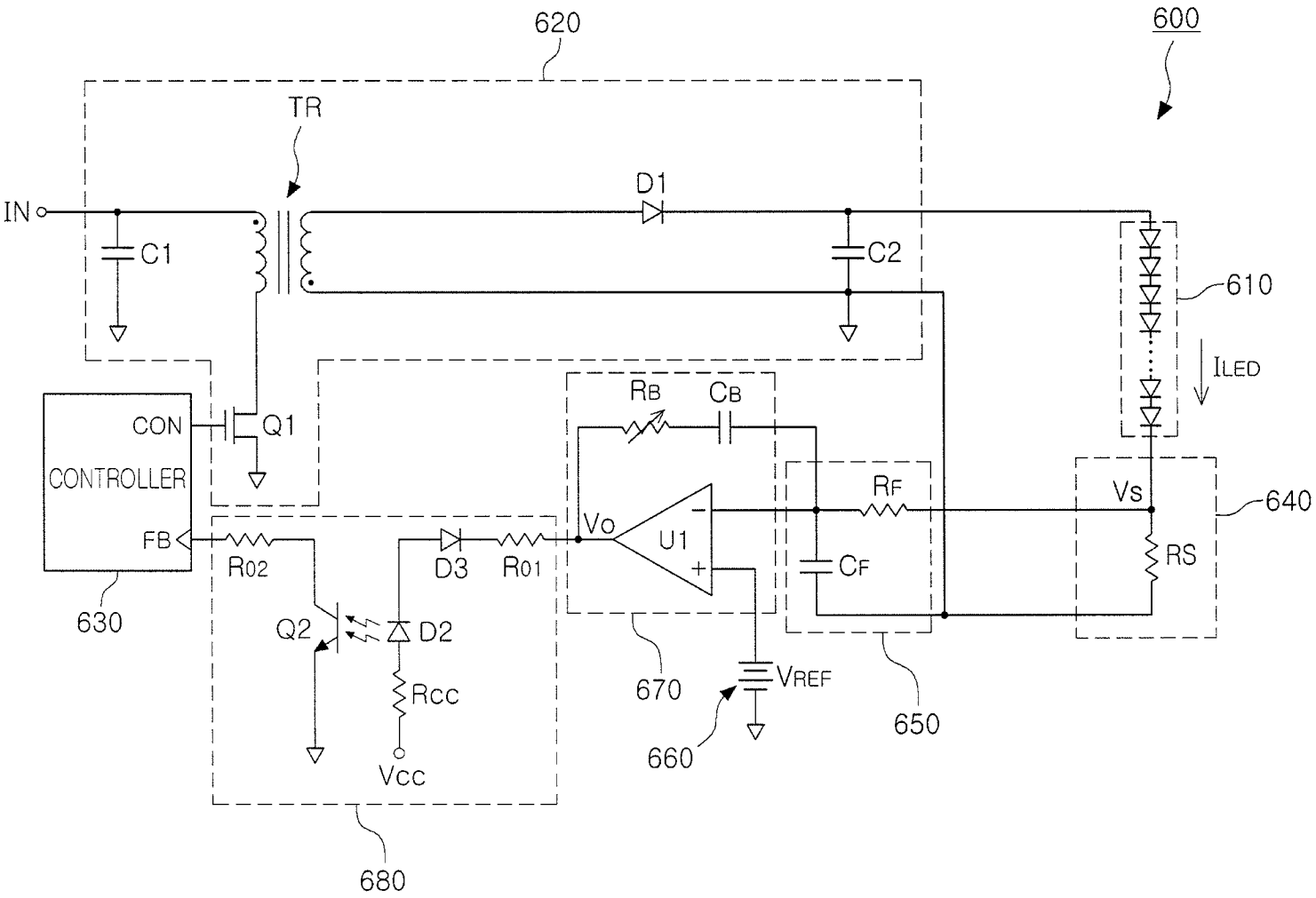

Referring to FIG. 8, main components of an LED driving apparatus 600 may be similar to those in the example embodiments illustrated in FIGS. 6 and 7, except for a feedback circuit. Similarly to the descriptions with reference to FIGS. 6 and 7, a converter 620 may be implemented by a variety of circuits, e.g., a PFC converter, a buck converter, a boost converter, a buck-boost converter, a forward converter, an LLC converter, an LCC converter, or a flyback converter.

In an example embodiment illustrated in FIG. 8, a feedback circuit may include a current detection circuit 640, a filter 650, a reference voltage generating circuit 660, an error amplifier 670, and a photocoupler 680. In the example embodiment illustrated in FIG. 8, a feedback resistor $R_B$ in the error amplifier 670 may be implemented, for example, as a variable resistor.

In one embodiment, when light output of LEDs 610 (which receive rated current output from the converter 620 to emit light) is lower than a desired light output, the rated current of the converter 620 may be increased by adjusting feedback resistance $R_B$. Similar to the example embodiment of FIG. 7 in which the resistance of the filter resistor $R_F$ is controlled, the voltage gain of the error amplifier 670 may be changed by adjusting feedback resistance $R_B$. A maximum value of a current output by the converter 620 may increase by adjusting feedback resistance $R_B$ by a user signal, and a rated current may also be increased without a separate change in circuit design or addition of a device.

Figure 9:
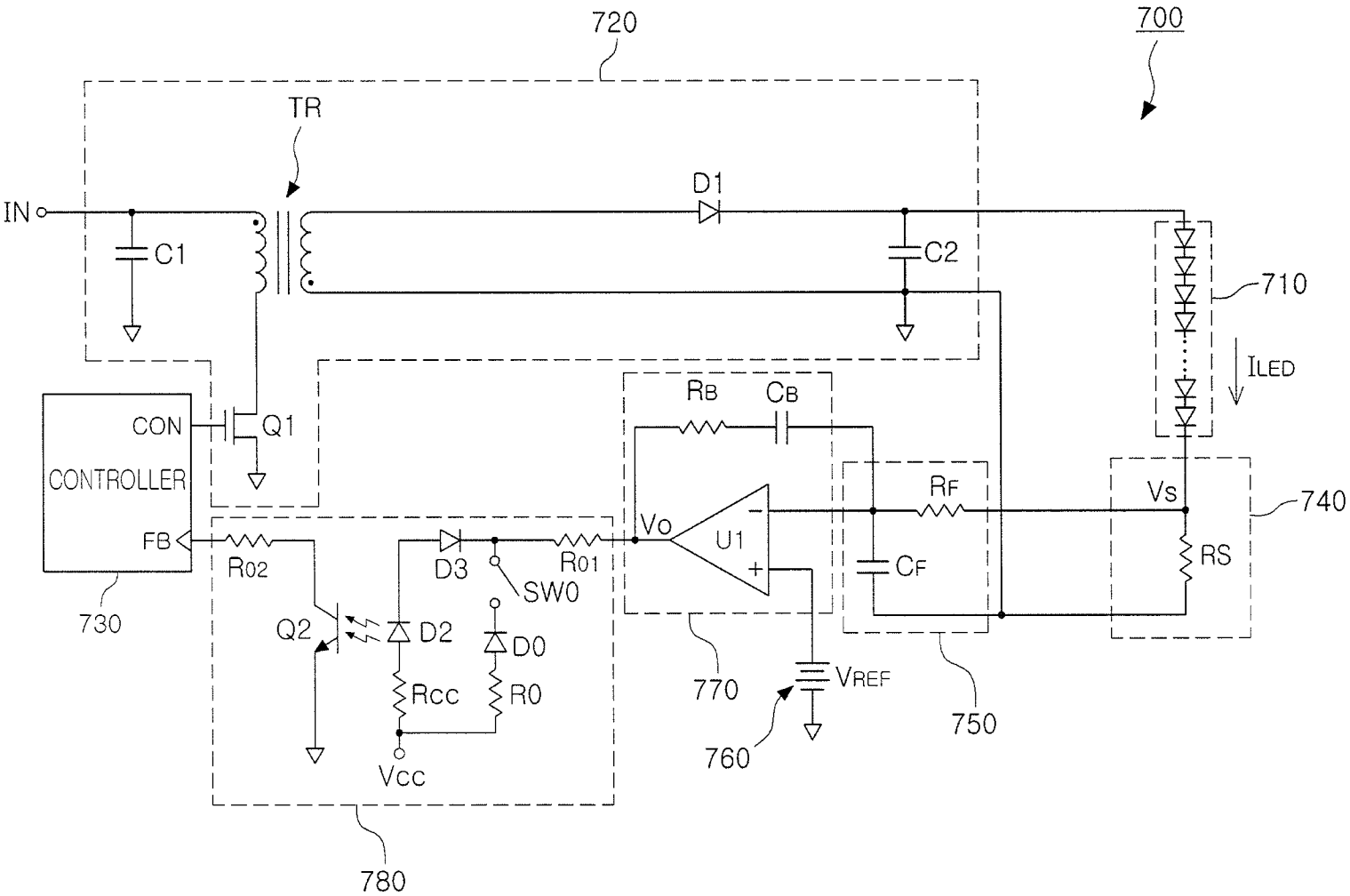

Referring to FIG. 9, an LED driving apparatus 700 may include a converter 720, a controller 730, a current detection circuit 740, a filter 750, a reference voltage generating circuit 760, an error amplifier 770, and a photocoupler 780. In this case, the current detection circuit 740, the filter 750, the reference voltage generating circuit 760, the error amplifier 770, and the photocoupler 780 may provide a feedback circuit. The controller 730 may adjust a rated current of the converter 720 based on a feedback signal provided by the feedback circuit.

In an example embodiment illustrated in FIG. 9, the magnitude of the feedback signal may be adjusted by adding or subtracting a DC component of an output voltage Vo in an output terminal of the error amplifier 770. With reference to FIG. 9, an offset adjusting circuit including a resistor R0, a diode D0 and an output terminal switch SW0 may be added to the output terminal of the error amplifier 770. For example, when the output terminal switch SW0 is turned on, a current flowing to a light emitting diode D2 of the photocoupler 780 may be reduced. As impedance of a light-receiving element Q2 is changed according to a decrease in the light output of the light emitting diode D2, the feedback signal may be changed. The controller 730 may adjust a rated current of the converter 720 based on the change of the feedback signal. In an example embodiment, the controller 730 may increase the rated current of the converter 720 in accordance with a change in a feedback signal based on an increase in impedance of the light-receiving element Q2.

Figure 10:
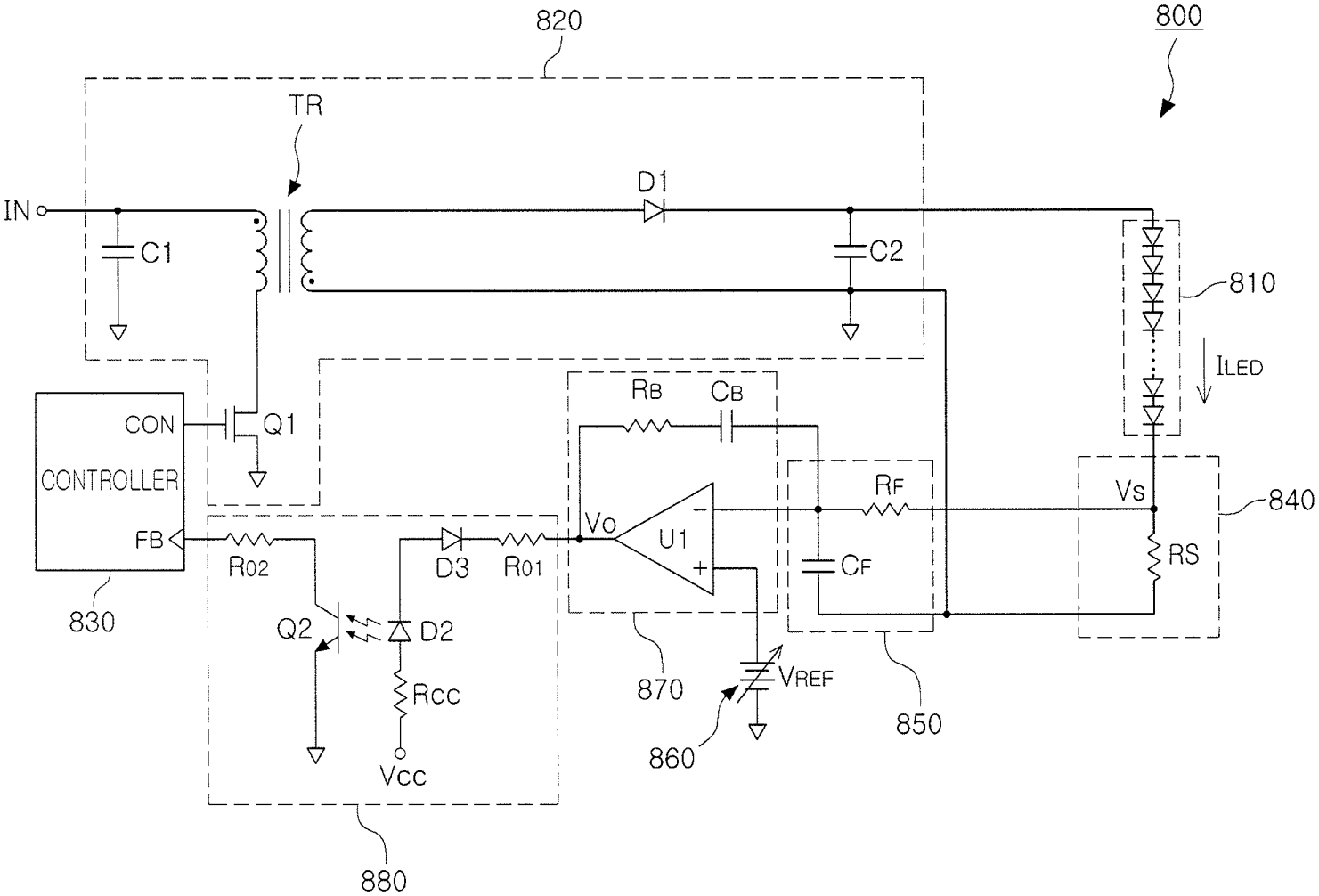

Referring to FIG. 10, a feedback circuit to change a rated current of an LED driving apparatus 800 may include a current detection circuit 840, a filter 850, a reference voltage generating circuit 860, an error amplifier 870, and a photocoupler 880. In an example embodiment illustrated in FIG. 10, a reference voltage $V_{REF}$ output from the reference voltage generating circuit 860 may not be a constant voltage, and a user signal may adjust a magnitude of the reference voltage $V_{REF}$.

As the reference voltage $V_{REF}$ increases, an output of the error amplifier 870 may increase. Thus, light output of a light emitting diode D2 of the photocoupler 880 may decrease to change a feedback signal input to the controller 830. The controller 830 may increase a rated current of the converter 820 based on the change in the feedback signal due to the decrease in the light output of the light emitting diode D2. For example, when light output of LEDs 810 does not reach a desired light output even when the converter 820 outputs a rated current, a user may obtain a desired light output by increasing the reference voltage $V_{REF}$ to increase the rated current of the converter 820.

Figure 11:
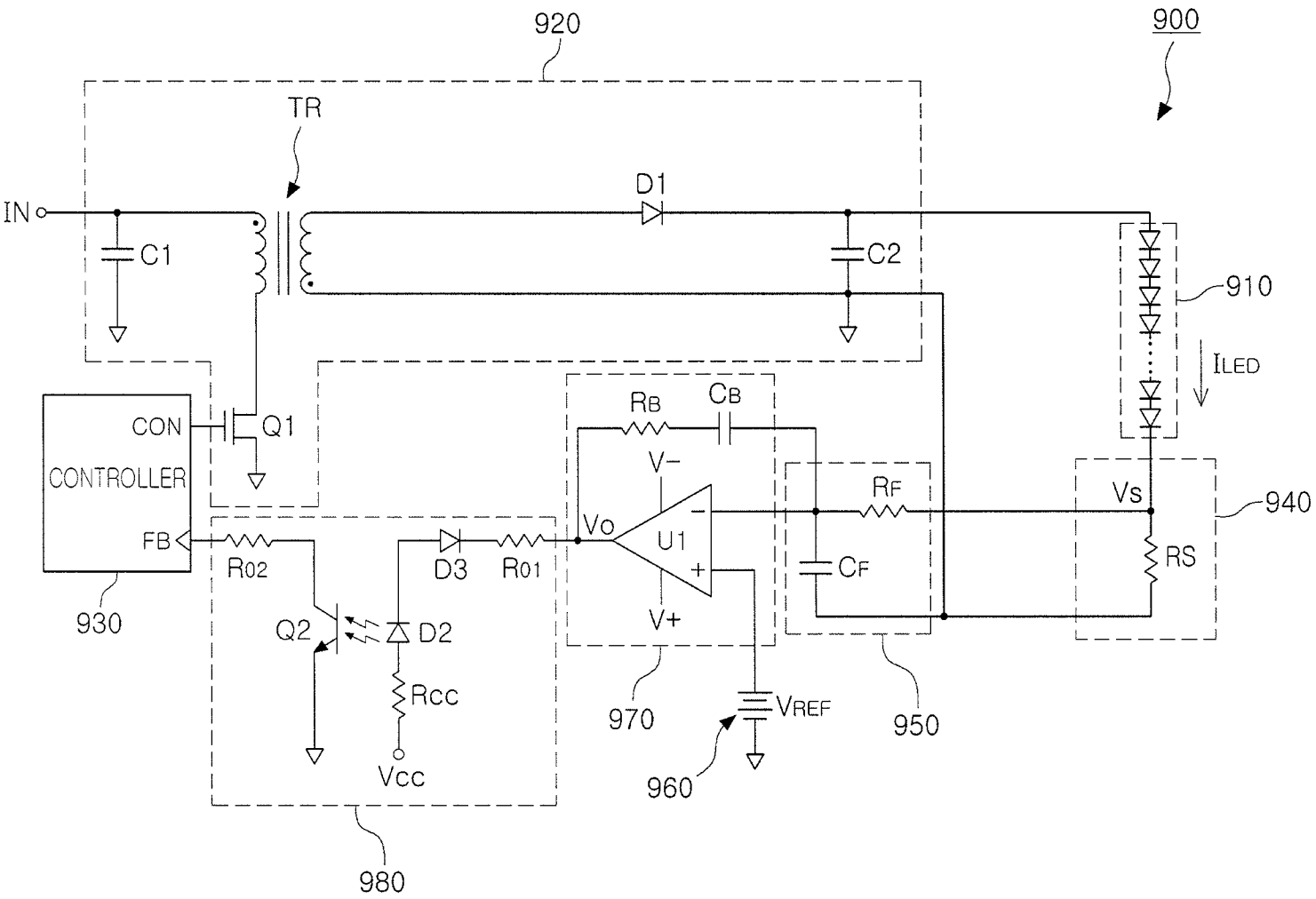

Referring to FIG. 11, a feedback circuit of an LED driving apparatus 900 may include a current detection circuit 940, a filter 950, a reference voltage generating circuit 960, an error amplifier 970, and a photocoupler 980. In an example embodiment illustrated in FIG. 11, a user may adjust driving voltages V+ and V− of an operational amplifier U1 in the error amplifier 970.

The driving voltages V+ and V− input to the operational amplifier U1 may affect a voltage gain of the error amplifier 970. For example, when light output of LEDs 910 does not reach a required value even when the converter 920 outputs a rated current, a user may adjust the driving voltages V+ and V− to forcibly increase a voltage gain of the error amplifier 970.

As the voltage gain of the error amplifier 970 increases, light output of a light emitting diode D2 of the photocoupler 980 may decrease and impedance of a light-receiving element Q2 may increase. The controller 930 may increase the rated current of the converter 920, in accordance with a change in a feedback signal, based on an increase in impedance of the light-receiving element Q2. Thus, a user may easily adjust the rated current of the converter 920, without having to perform a circuit redesign, replace a device, add separate circuit elements, or other forms of work.

As described above, the LED driving apparatus according to example embodiments may provide a user with a current control unit for adjusting a rated current of a converter supplying driving power to LEDs. The current control unit may be included in a feedback circuit. At least one of sensing resistance detecting a current flowing through LEDs, resistance of resistors determining a voltage gain of an error amplifier, and a driving voltage of the error amplifier may be changed by the current control unit. In one embodiment, a DC component may be added to an output voltage of the error amplifier by the current control unit. A user signal may change a feedback signal, input to a controller by a feedback circuit, by manipulating the current control unit. The controller may then increase or decrease a maximum value of current output by the LED driving apparatus (e.g., rated current) based on the changed feedback signal.

According to the above-described configuration in example embodiments, when light output of LEDs is unsatisfactory (even when the LED driving apparatus outputs a rated current), a user operates the current control unit to forcibly increase the rated current of the LED driving apparatus. In a manner different from one type of LED driving apparatus (in which only a function of increase/decrease of an output current is provided within a predetermined rated current range), one or more of the embodiments described herein allow a user to generate a signal to increase the rated current itself. For example, when light output is lower than a desired light output during testing or actually installation or operation of the LED driving apparatus, the rated current of the LED driving apparatus may be forcibly increased to obtain a desired light output.

In an example embodiment, a controller in an LED driving apparatus may be connected to an external controller that is able to communicate therewith by wired or wireless communications and that may adjust a rated current of the LED driving apparatus based on a control command transmitted by the external controller. The controller may increase the rated current of the LED driving apparatus by adjusting sensing resistance in a feedback circuit, a reference voltage, a gain of an error amplifier, and/or a DC component in an output voltage of the error amplifier based on the transmission command.

Figure 12:
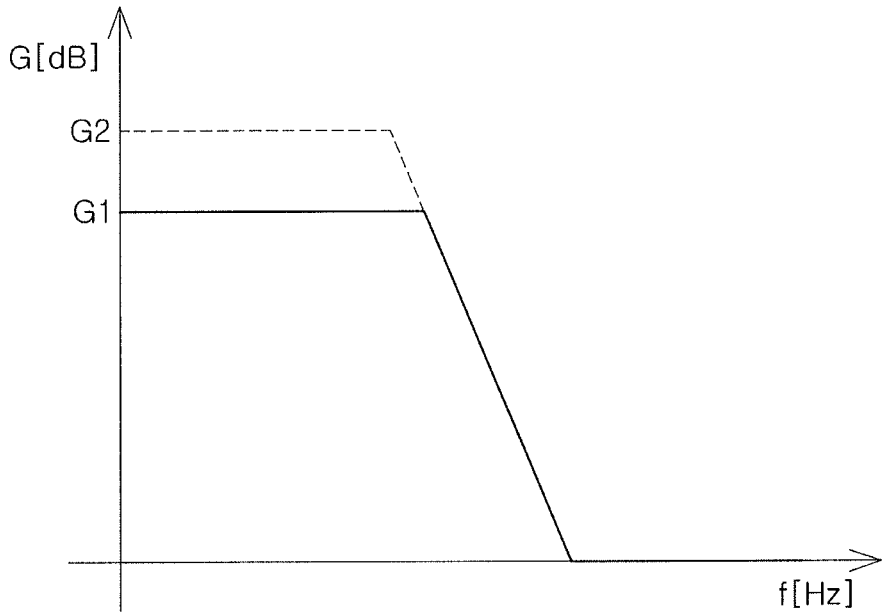
FIGS. 12 and 13 illustrate embodiments for operating an LED driving apparatus.
Figure 13:
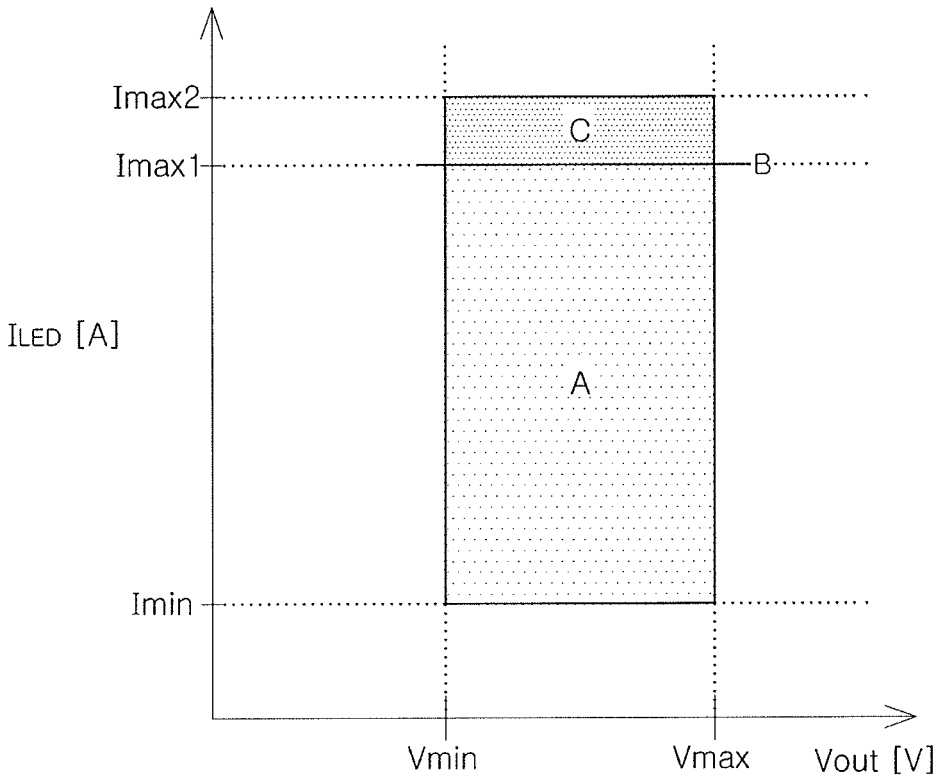

FIGS. 12 and 13 illustrating embodiments for operating an LED driving apparatus.

FIG. 12 illustrates a voltage gain of an error amplifier in a feedback circuit of an LED driving apparatus. In FIG. 12, voltage gain of the error amplifier may be higher when a voltage gain curve of the error amplifier is the same as that of graph G2, than when a voltage gain curve of the error amplifier is the same as that of graph G1. The voltage gain curve of the error amplifier may be changed from being the same as that of graph G1 to that of graph G2, by decreasing resistance of a current sensing resistor, increasing an impedance value of a filter, and/or directly increasing the gain of an operational amplifier in the error amplifier, by a user using the current control unit. As the voltage gain of the error amplifier increases, the controller may increase a maximum value of a current that may be output by the LED driving apparatus. Thus, the rated current of the LED driving apparatus may be increased.

FIG. 13 illustrates a value of an output current $I_{LED}$ depending on an output voltage Vout of an LED driving apparatus. With reference to FIG. 13, a voltage-current relationship indicated by region B in the graph may correspond to a case where the output current $I_{LED}$ of the LED driving apparatus has a maximum value Imax1, e.g., when the LED driving apparatus outputs a rated current. A voltage-current relationship in region A of the graph may correspond to a case where the output current $I_{LED}$ may be changed regardless of the output voltage Vout, and may correspond to an LED driving apparatus in which a dimming function may be implemented.

On the other hand, an LED driving apparatus according to an example embodiment may provide a rated current boost function in which a rated current of the LED driving apparatus may be increased, in addition to a dimming function. In order to obtain desired light output, or when a rated current higher than a rated current of the LED driving apparatus is desired due to LED characteristics, a user may manipulate the current control unit in the feedback circuit of the LED driving apparatus to forcibly increase the rated current. Thus, as illustrated in region C of the graph of FIG. 13, a maximum value that the output current $I_{LED}$ of the LED driving apparatus may be increased.

In region C in FIG. 13, a maximum value Imax2 of the output current of the LED driving apparatus may be increased, as compared to that of region B. In addition, a user may adjust a value of output current from the maximum value Imax2 to a minimum value Imin using the dimming function of the LED driving apparatus. Thus, the light output of LEDs may be adjusted in a relatively high brightness range.

Figure 14:
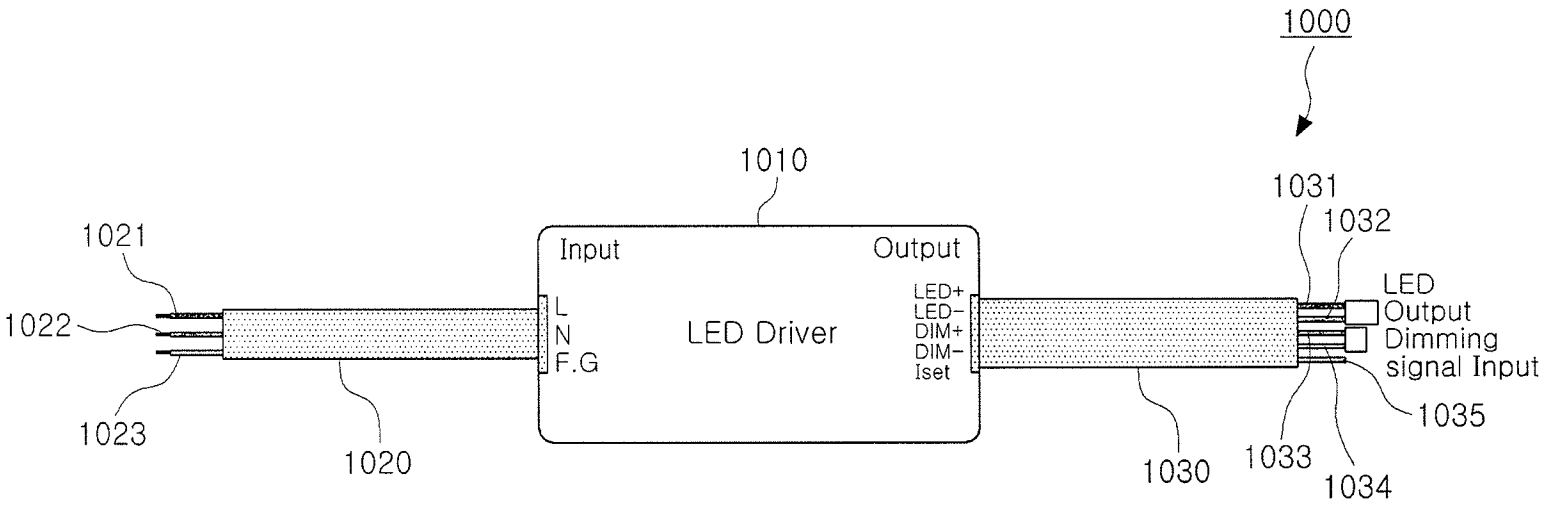
FIG. 14 illustrate another embodiment of an LED driving apparatus.

FIG. 14 illustrates another embodiment of an LED driving apparatus 1000 which may include an LED driver 1010, an input harness 1020, and an output harness 1030. The input harness 1020 may include a plurality of input terminals 1021 to 1023 for receiving alternating current (AC) power. The output harness 1030 may include a plurality of output terminals 1031 to 1034 for transmitting driving power generated by the LED driver to LEDs.

The LED driver 1010 may generate driving power using AC power input through the input harness 1020. The LED driver 1010 may include a rectifier circuit, a converter circuit, a controller, and a feedback circuit. The rectifier circuit may convert AC power to DC power, and the converter circuit may generate driving power using the DC power. Depending on the application field of the LED driving apparatus 1000, the LED driver 1010 may have waterproof and dustproof performance. In an example embodiment, the LED driver 1010 may be sealed with a sealing member for preventing penetration of moisture, dust, or other external debris.

In an example embodiment, the LED driver 1010 may output a constant current to drive the LEDs connected to the output harness 1030. The magnitude of the constant current may be determined by the controller. The controller may provide a dimming function which involves adjusting the magnitude of the constant current output by the LED driver 1010 within a rated current range.

On the other hand, even when the LED driver 1010 outputs a constant current of a maximum magnitude within the rated current range, a desired light output may not be obtained due to a change in characteristics of forward voltage of LEDs connected to the LED driver 1010, and/or fabrication error occurring in fabrication and design of LEDs. In order to solve such a problem, in an example embodiment, a current control terminal 1035 for adjusting a maximum current value that may be output by the LED driver 1010 may be included in the output harness 1030. The current control terminal 1035 may also be included in the input harness 1020 according to an example embodiment.

A user may manipulate the current control terminal 1035, in a process of installing and testing the LED driving apparatus 1000 or during use thereof, to increase the value of a maximum current that may be output by the LED driver 1010 within a rated current range. Thus, even when a desired light output may not be obtained from LEDs connected to the LED driving apparatus 1000, a desired light output may be obtained with simple manipulation, and without having to change the design of LEDs used as light sources or circuits in the LED driver 1010 and/or without having to replace the LED driving apparatus 1000. In addition, since a maximum current output by the LED driver 1010 may be increased only by operating the current control terminal included in the output harness 1030, without an operation of the LED driver 1010 including a circuit, waterproof and dustproof performance of the LED driver 1010 may be maintained as is.

Figure 15:
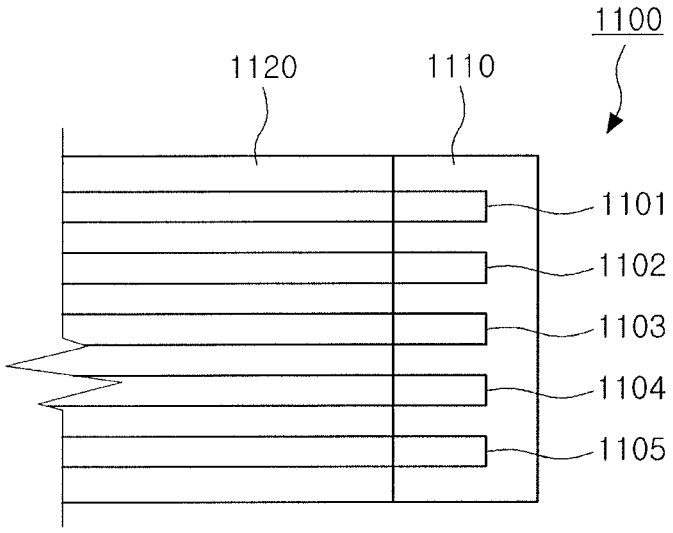
FIGS. 15 to 17 illustrate embodiments of harnesses for LED driving apparatuses.
Figure 16:
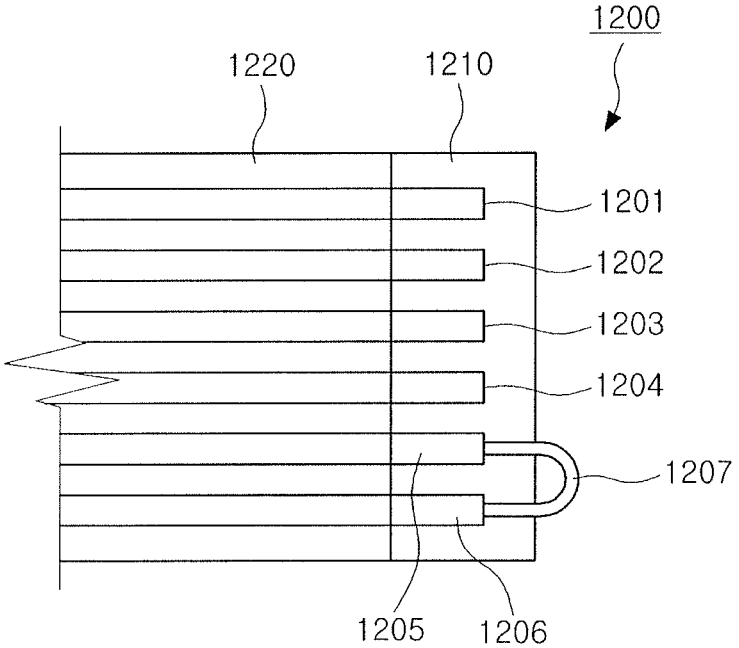
Figure 17:
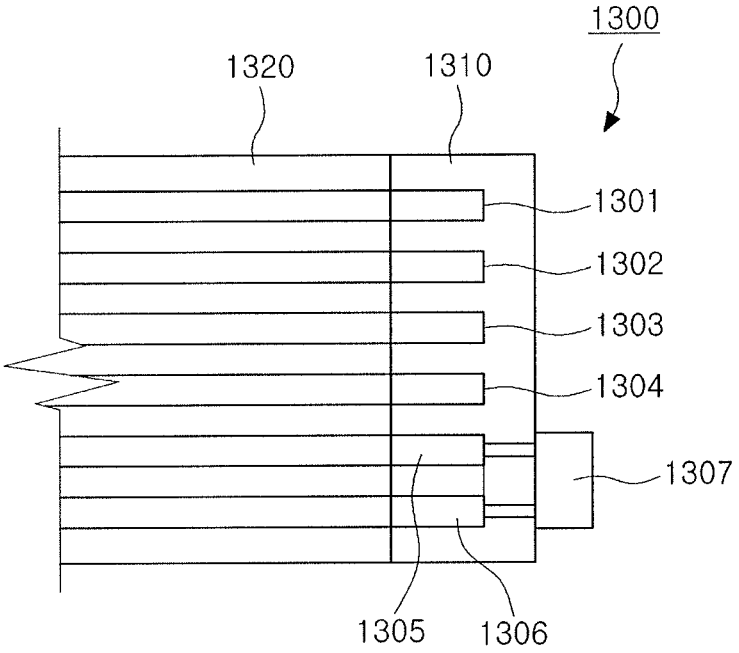

FIGS. 15 to 17 illustrating embodiments of harnesses 1100, 1200 and 1300 in LED driving apparatuses. Harnesses 1100, 1200 and 1300 may be output harnesses or input harnesses in an LED driving apparatus that are connected to the LED driving apparatus.

Referring to FIG. 15, the harness 1100 may include a connector 1110 and a cable 1120, and a plurality of wirings may be provided over the connector 1110 and the cable 1120. The plurality of wirings may be connected to a plurality of terminals 1101 to 1105 on the connector 1110, and an electrical signal may be input or output through the plurality of terminals 1101 to 1105.

For example, when the harness 1100 is an output harness connected to the LED driver, the plurality of terminals (e.g., first and second terminals 1101 and 1102) may respectively output driving power required to drive the LEDs. In addition, third and fourth terminals 1103 and 1104 may respectively receive an external dimming signal. In an example embodiment, the second terminal 1102 and the fourth terminal 1104 may be respectively connected to a reference (e.g., ground) terminal.

In an example embodiment illustrated in FIG. 15, for example, a fifth terminal 1105 may be provided as a current control terminal. When the LED driving apparatus including the harness 1100 is manufactured and provided as a product, the product may be shipped in a state in which the fifth terminal 1105 is in an open state as illustrated in FIG. 15. For example, when a desired light output is not obtained from the LEDs operated by the LED driving apparatus in a process of testing or installing the LED driving apparatus, a user may connect the fifth terminal 1105 to the second terminal 1102 or the fourth terminal 1104, for example, using a short wiring connecting the fifth terminal 1105 to a ground terminal.

When the fifth terminal 1105 is connected to the ground terminal, the value of a maximum current that may be output by the LED driving apparatus including the harness 1100 may be increased or decreased. For example, in one embodiment, a rated current of the LED driving apparatus may be increased or decreased. Since the rated current of the LED driving apparatus may be increased or decreased by only connecting the fifth terminal 1105 to the second terminal 1102 or the fourth terminal 1104, a desired light output may be simply obtained without having to redesign a circuit, change in device, or perform another kind of inconvenient process. In an example embodiment, when the fifth terminal 1105 is connected to the second terminal 1102 or the fourth terminal 1104, the rated current may be increased or decreased by about 10%.

Referring to FIG. 16, the harness 1200 may include a connector 1210 and a cable 1220. The connector 1210 may include a plurality of terminals 1201 to 1205 connected to a plurality of wirings. An electrical signal may be input or output through the plurality of terminals 1201 to 1205.

Similar to the example embodiment illustrated in FIG. 15, when the harness 1200 is an output harness connected to the LED driver, the plurality of terminals (e.g., first and second terminals 1201 and 1202) may respectively output driving power to drive LEDs. In addition, third and fourth terminals 1203 and 1204 may respectively receive an external dimming signal. In an example embodiment, the second terminal 1202 and the fourth terminal 1204 may be respectively connected to a ground terminal.

In an example embodiment illustrated in FIG. 16, for example, fifth and sixth terminals 1205 and 1206 may serve as current control terminals. When the LED driving apparatus including the harness 1200 is manufactured and shipped, the LED driving apparatus may be shipped in a state in which the fifth and sixth terminals 1205 and 1206 are connected to each other by a shorting wire 1207, for example, as illustrated in FIG. 16. In one embodiment, when a desired light output is not obtained from the LEDs operated by the LED driving apparatus, a user may cut the shorting wire 1207 connecting the fifth terminal 1205 to the sixth terminal 1206, thereby electrically separating the fifth terminal 1205 from the sixth terminal 1206.

When the fifth terminal 1205 and the sixth terminal 1206 are electrically separated from each other, a rated current of the LED driving apparatus including the harness 1200 may be changed. The rated current of the LED driving apparatus may be changed only by separating the fifth terminal 1205 from the sixth terminal 1206, which were to each other by the shorting wire 1207 in a production/manufacturing process. As a result, a desired light output may be simply obtained without having to redesign a circuit, change in device, or perform another kind of inconvenient process.

Referring to FIG. 17, the harness 1300 may include a connector 1310 and a cable 1320. The connector 1310 may include a plurality of terminals 1301 to 1305 connected to a plurality of wirings. For example, when the harness 1300 is an output harness connected to an LED driver, the plurality of terminals (e.g., first and second terminals 1301 and 1302) may respectively output driving power to drive LEDs. In addition, third and fourth terminals 1303 and 1304 may respectively receive an external dimming signal. In an example embodiment, the second terminal 1302 and the fourth terminal 1304 may be respectively connected to a ground terminal.

In the example embodiment of FIG. 17, fifth and sixth terminals 1305 and 1306 may serve as current control terminals. When the LED driving apparatus including the harness 1300 is manufactured and shipped, the LED driving apparatus may be shipped in a state in which the fifth and sixth terminals 1305 and 1306 are connected to a switch 1307. For example, when a desired light output is not obtained from the LEDs operated by the LED driving apparatus, a user may change an on/off state of the switch 1307 to connect or disconnect the fifth and sixth terminals 1305 and 1306.

In an example embodiment, the switch 1307 may be in a turned-off state when the LED driving apparatus is shipped. Then, for example, when the switch 1307 is turned on by a user to electrically connect the fifth terminal 1305 and the sixth terminal 1306 to each other, a rated current of the LED driving apparatus including the harness 1300 may be changed. Since the rated current of the LED driving apparatus may be changed by only separating the fifth terminal 1305 and the sixth terminal 1306 from each other by operating the switch 1307, a desired light output may be simply obtained without having to redesign a circuit, change in device, or perform another kind of inconvenient process.

In the example embodiments of FIGS. 15 to 17, the current control terminals 1105, 1205, 1206, 1305, and 1306 may be electrically connected to the feedback circuit in the harnesses 1100, 1200, and 1300. In the example embodiment of FIG. 17, the switch 1307 connecting the fifth terminal 1305 and the sixth terminal 1306 may be a first switching element SW1 in the current detection circuit 440. For example, when a user turns on the switch 1307, a first sensing resistor RS1 and a second sensing resistor RS2 may be connected in parallel to decrease a sensing voltage Vs. Thus, an output voltage Vo of an error amplifier 470 may decrease to increase a rated current of the converter 420. The current control terminals 1105, 1205, 1206, 1305 and 1306 may be connected, for example, to a node for adjusting the value of at least one of circuit elements in a feedback circuit, in order to change a feedback signal.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The controllers, converters, feedback circuits, rectifiers, detectors, filters, error amplifiers, isolation circuits, filters, and other signal generating, signal providing, and signal processing features of the embodiments disclosed herein may be implemented in logic which, for example, may include hardware, software, or both. When implemented at least partially in hardware, the controllers, converters, feedback circuits, rectifiers, detectors, filters, error amplifiers, isolation circuits, filters, and other signal generating, signal providing, and signal processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, converters, feedback circuits, rectifiers, detectors, filters, error amplifiers, isolation circuits, filters, and other signal generating, signal providing, and signal processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned example embodiments, the maximum value of a rated current of an LED driving apparatus may be changed in a process of installing and/or operating a lighting apparatus, depending on characteristics of a plurality of LEDs connected to the LED driving apparatus. Thus, an LED driving apparatus may be provided for driving LEDs of various specifications without having to perform a separate design change or product reproduction process. Further, adjusting the maximum value of a rated current of the LED driving apparatus may be performed using harness terminals connected to the LED driving apparatus. As a result, the LED driving apparatus may have excellent waterproof and dust-proof characteristics.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, various changes in form and details may be made without departing from the spirit and scope of the embodiments set forth in the claims.

What is claimed is:

1. A light emitting diode (LED) driving apparatus, comprising:

a rectifier to convert alternating current (AC) power to direct current (DC) power;

a converter to supply a driving power to a plurality of LEDs based on the DC power;

a feedback circuit to generate a feedback signal based on a current flowing in the plurality of LEDs and including an adjustment circuit to adjust a magnitude of the feedback signal; and a controller to change a maximum value of a current output by the converter based on the adjusted magnitude of the feedback signal, wherein the adjustment circuit includes a light emitting diode, and the feedback signal is adjusted by independently changing a light amount of the light emitting diode based on the current flowing in the plurality of LED.

2. The LED driving apparatus as claimed in claim 1, wherein the feedback circuit includes:

a current detector to detect the current flowing in the plurality of LEDs and to generate a sensing voltage based on the detected current, a reference voltage generator to generate a reference voltage, and an error amplifier to compare the sensing voltage with the reference voltage and to output the feedback signal.

3. The LED driving apparatus as claimed in claim 2, wherein the current detector includes a resistance circuit with a variable resistor connected to the plurality of LEDs in series, and wherein the feedback signal is adjusted by changing a resistance value of the variable resistor according to a user set value.

4. The LED driving apparatus as claimed in claim 3, wherein:

the resistance circuit includes a plurality of resistive elements connected to each other in parallel, and at least one switching element connecting or disconnecting the plurality of resistive elements.

5. The LED driving apparatus as claimed in claim 2, wherein the feedback circuit includes a filter circuit connected between the current detector and an input terminal of the error amplifier.

6. The LED driving apparatus as claimed in claim 5, wherein the feedback circuit is to generate the feedback signal based on impedance of the filter circuit, and wherein the feedback signal is adjusted by changing the impedance of the filter circuit according to a user set value.

7. The LED driving apparatus as claimed in claim 2, wherein the feedback circuit is to generate the feedback signal based on a change in the reference voltage.

8. The LED driving apparatus as claimed in claim 2, wherein the feedback circuit is to generate the feedback signal based on a change in gain of the error amplifier, and wherein the feedback signal is adjusted by changing a resistance value of a feedback resistor of the error amplifier according to a user set value.

9. The LED driving apparatus as claimed in claim 2, wherein the feedback circuit includes an offset adjusting circuit, connected to an output terminal of the error amplifier, to adjust the magnitude of the feedback signal by adjusting a DC component of an output voltage of the error amplifier, and wherein adjusting the DC component is performed by independently changing the light amount of the light emitting diode according to a user set value.

10. The LED driving apparatus as claimed in claim 1, wherein the feedback circuit includes an isolation circuit to transmit the feedback signal with the adjusted magnitude to the controller.

11. The LED driving apparatus as claimed in claim 1, wherein the converter includes:

a transformer to increase or decrease a voltage of the DC power, a main switch connected to a primary winding of the transformer, and an output circuit, connected to a secondary winding of the transformer, to supply the driving power to the plurality of LEDs.

12. The LED driving apparatus as claimed in claim 11, wherein the controller is to input a control signal to the main switch and change at least one of a duty ratio and a switching frequency of the control signal to adjust the driving power.

13. The LED driving apparatus as claimed in claim 11, wherein the controller is to adjust at least one of a duty ratio and a switching frequency of a control signal based on an external control command received via a predetermined communications protocol.

* * * * *